US005086561A

United States Patent [19]

Nathan

[11] Patent Number: 5,086,561

[45] Date of Patent: Feb. 11, 1992

[54] SAFETY KNIFE AND PROTECTION GARMENT FOR PROCESSING OPERATIONS

[76] Inventor: Daniel M. Nathan, 593 Barkworth Rd., Clemmons, N.C. 27012

[21] Appl. No.: 733,067

[22] Filed: Jul. 17, 1991

Related U.S. Application Data

[63] Continuation of Ser. No. 528,437, May 25, 1990, abandoned.

[51] Int. Cl.[5] ..... B26B 3/02; B26B 3/00; B26B 9/00; B26B 3/06

[52] U.S. Cl. ..... 30/1; 30/161; 30/162; 30/164.5

[58] Field of Search ..... 30/1, 123.7, 154–156, 30/161, 162, 164.5, 210, 211; 452/51, 52, 53, 54

[56] References Cited

U.S. PATENT DOCUMENTS

| | | | |
|---|---|---|---|
| D. 302,839 | 8/1989 | Crain | D22/118 |
| 700,617 | 5/1902 | Cobaugh | 30/123.7 |
| 2,676,406 | 4/1954 | Hoke . | |
| 2,764,814 | 10/1956 | Jecker . | |
| 3,507,002 | 4/1970 | McDonald | 452/53 |
| 4,324,044 | 4/1982 | Shahinian, Jr. | 30/294 |
| 4,347,665 | 9/1982 | Glesser | 30/161 |
| 4,476,597 | 10/1984 | Gobbi | 30/164.5 |
| 4,730,344 | 3/1988 | Sonner | 30/155 |
| 4,787,146 | 11/1988 | Gaskins | 30/299 |
| 4,821,416 | 4/1989 | Dullinger | 30/294 |
| 4,884,307 | 12/1989 | Flood | 30/162 |

OTHER PUBLICATIONS

Advertising Brochure-Mailite Stainless Steel Mesh Aprons, p. 12 Hantover.

Advertising Brochure-Hycar Coated Aprons, p. 20 Hantover.

*Primary Examiner*—Frank T. Yost
*Assistant Examiner*—Paul M. Heyrana, Sr.
*Attorney, Agent, or Firm*—Michael Sand Co.

[57] ABSTRACT

This invention relates to an improved safety knife and combination of swafety knife and protective garment for meat, fish and poultry processing involving cutting and thrusting operations. The safety knife includes a plurality of projecting serrations closely adjacent its sharpened point adapted to snagging engagement of a protective garment or clothing worn by the user to prevent deep penetration of the knife point to avoid injury to the user. The combination is employed in conjunction to provide significant user protection in fast-paced food processing operations. The cutting edge of the knife may be periodically sharpened without loss of safety protection provided by its serrated point for use in all types of cutting and thrusting operations.

15 Claims, 6 Drawing Sheets

SAFETY KNIFE AND PROTECTION GARMENT FOR PROCESSING OPERATIONS

This application is a continuation of application Ser. No. 07/528,437, filed May 25, 1990.

BACKGROUND OF THE INVENTION

1. Technical Field

This invention relates to a safety knife and the combination of a safety knife and a protective garment which are employed in conjunction for significant protection to the user of such knife used in meat, fish and poultry processing operations to avoid injury to the user by the improved knife point being incapable of deep penetration of the protective garment during such processing operations. The knife point includes a series of projecting serrations adapted to snagging engagement with the protective garment to avoid injury to the user or processing operator.

2. Background Information

While the subject knife provides protection against injury to the user wearing any kind of clothing, it is especially effective for use by commercial users of such instruments who normally wear protective metal-containing garments to safeguard themselves against injury when working in food cutting operations. The metallic-type garments are heavy and unwieldy placing a wearisome weight burden on the wearer. It is a primary objective of this invention to eliminate the use of such heavy metallic garments which are extremely tiresome.

Recent developments in the manufacture of protective garments such as aprons, gloves, sleeve, arm and leg coverings, or the like have been placed on the use of yarns consisting of various combinations of synthetic fibers and metallic cores and outer wrappings of such fibers and steel wire strands. Such garments are commonly fabricated from yarn which has been formed into the fabric or woven material for forming such garments by conventional knitting, fabric forming and weaving apparatus. Examples of such yarns and protective garments produced therefrom are disclosed in U.S. Pat. Nos. 4,384,449; 4,470,251; 4,777,789; and 4,838,017. The protective garments made from such yarns and woven materials have previously been utilized with conventional knives in solid food processing, especially in meat, fish and poultry processing operations, which are frequently conducted in assembly line fashion. Such garments, when worn by the operator, have been designed to prevent cutting or slashing penetration of the garment by the knife as wielded in such operations. The knives of various sizes have virtually all been formed having conventional curved points with the usual sharpened cutting edges. The wide variety of fabrics used to form such protective garments are particularly effective against cutting and slashing movements by users of conventional knives; however, neither the knives nor fabrics have provided significantly effective protection against thrusting or penetrating type movements of the knife blade. Many of the protective garments are multi-layered having a biased structure adapted to resist cutting and slashing. Very few of such fabrics and virtually none of the cutting knives employed therewith have been structured to avoid thrusting movement or low-velocity ballistic effects which may allow deep penetration of the garment and possible injury to the user.

Previously, most of the benefits of the improved yarns and their fabrication into protective garments has been their resistance to being cut with a sharp instrument such as a knife. The use of various fiber combinations together with wire as the core for a covered yarn has provided improvements in cut or slash resistance to protect the wearer of such garments; however, conventional knives have been used therewith with virtually no improvement to conventional knives for the aforesaid processing operations. Knives have been provided which have conventional points which are sharpened on their cutting edge and which occasionally allow highly undesirable knife penetration through the garment which, while cut and slash resistant, is not resistant to thrusting or high-angular penetration of the garment. Thrusting movement of the knives has heretofore been subject to particular avoidance in the training and education of meat cutters to prevent injury to those wearing the above-described garments. Such restricted movement has required processing personnel to be extremely careful in their cutting operations to avoid possible injury to themselves or others. As stated, the use of conventional knives requires generally restrictive movements by the user to avoid possible injury wherein the protective garment can be penetrated.

Most of the protective garments, metallic or otherwise, utilized in commercial operations such as gloves, aprons, arm and leg coverings, and the like have provided protection against normal cutting movement; however, none have been specifically designed to counteract thrusting movement of a conventional knife which is capable of penetrating the garment to allow possible self-inflicted injury to the user.

DISCLOSURE OF THE INVENTION

Objectives of the present invention include providing an improved safety knife which prevents deep penetration either of clothing and/or a protective garment worn by a user of such knife when the knife is employed in thrusting or penetrating type of movements such as in solid food processing. The subject knife is intended to eliminate the use of metallic protective garments and the heavy weight involved which is extremely tiring to the wearer.

Another objective of the present invention is to provide an improved safety knife which may be employed in combination with a protective garment specifically designed to prevent deep penetration of the knife point to prevent possible self-inflicted injury to the user of such knife.

A further objective of the present invention is to provide an improved combination of safety knife and protective garment which is specifically designed for use with such knife to facilitate snagging engagement with the garment to prevent possible injury to the user of the knife.

A still further objective of the present invention is to provide a improved knife having a plurality of serrations on its non-cutting edge closely adjacent the terminating point of the knife blade which knife may be periodically sharpened during its life without loss of safety protection.

A still further objective of the invention is to provide an improved safety knife which can be mass produced relatively inexpensively having a series of 3 to 7 serrations adjacent the pointed end of the blade to prevent deep penetration of the knife blade in the event of thrusting movements thereof. Such knife is effective regardless of the type of garment worn by the user, although the most efficient protection is provided by the wearing of a multi-layered bias-structured protective garment formed of synthetic fibers adapted to snagged restrictive movement of the knife blade when employed in thrusting or penetrating type blade movement. The plurality of serrations extend upwardly and transversely of the blade longitudinal axis to permit repeated sharpenings of the cutting edge without loss of deep penetration protection.

SUMMARY OF THE INVENTION

The present invention relates to a new and improved safety knife which can be employed with a wide variety of protective garments. The safety knife includes a plurality of projecting serrations located adjacent its pointed end to obtain desired snagging of the protective garment or any type of clothing before any deep penetration of the knife can occur. The serrations on the knife point are located to be positively engaged by the fabric of the protective garment or clothing to prevent any deep penetration of the knife. The plurality of serrations are upwardly-projecting in a transverse direction to the longitudinal axis of the knife blade to be positively engaged by the garment fabric or fabrics which are normally utilized in multi-layered form in commercial operations to resist cutting and slashing movements. Depending upon the type of multi-layered composite fabric structures which are employed, the subject safety knife has a structure to snaggingly restrict high-angular penetration of the garment to avoid or prevent any type of serious puncture injury to the user.

The various patents set forth hereinabove indicate the wide variety of cut-resistant yarns which are utilized in the fabrication of cut-resistant protective garments, many of which have been designed for use with various cutting instruments such as well-known meat processing knives of various sizes. All such knives have relatively uniformly curved and lineal surfaces which terminate in a uniform point to allow sharpening of the knives for most efficient long-term use. The safety knife of the present invention having serrations adjacent its point may be sharpened in the usual manner without loss of safety protection provided by the subject knife. While the previous yarns for fabricating the protective garments have provided significant protection in food processing operations, the type of protection which has not been provided is the thrusting or forceful angular penetration of a sharpened knife directed transversely into such garment which has resulted in significant injury to users of conventional knives who must be continually mindful of certain thrusting movements to be avoided.

The safety knife and protective garment which are utilized in combination according to the present invention have numerous advantages over the prior art especially in the area of conventional knives which are employed with a wide variety of protective garments. A substantial advantage is obtained in the increased thrust resistance of the knife in its use in combination with protective articles of apparel worn by the user. Obviously, the subject knife also provides protection when used with all types of ordinary clothing worn by the user, but its most effective protection is obtained by the use of commercial and newly-developed protective garments some of which are described hereinbelow. The subject knife is capable of providing protection throughout a wide range of thrusting high-angular knife blade movements which can result in unintentional wounds or bodily harm to the user especially where loss of concentration against such undesirable movements can and does occur.

BRIEF DESCRIPTION OF THE DRAWINGS

A preferred embodiment of the invention, illustrative of the best mode in which applicant has contemplated applying the principles, is set forth in the following description and is shown in the drawings, and is particularly and distinctly out and set forth in the appended claims.

Similar numerals refer to similar parts throughout the drawings.

BEST MODE OF PRACTICING THE PRESENT INVENTION

As is well known, conventional knives having smoothly contoured sharp points are employed in virtually all types of solid food processing operations by meat cutters, butchers and similar personnel. The knives may have generally parallel cutting and non-cutting edges extending to the smoothly curved points of the cutting edges requiring frequent sharpening for their most efficient use.

Figure 1:
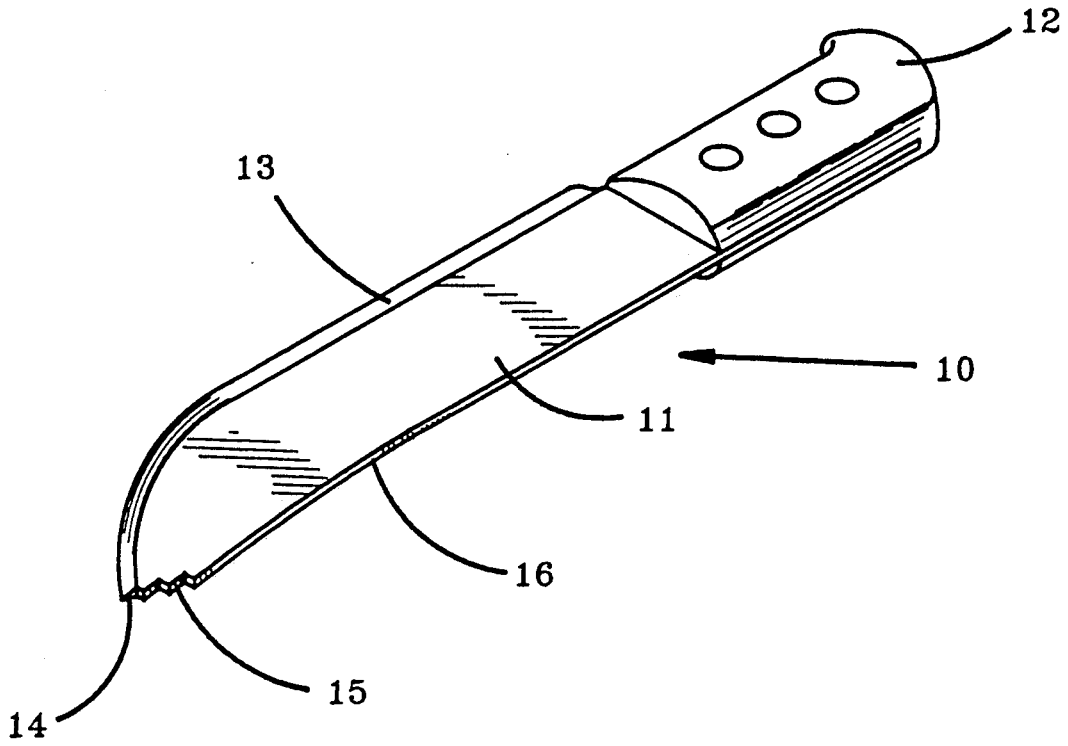
FIG. 1 is a perspective view of a safety knife fabricated in accordance with the present invention.

The safety knife of the present invention has been designated by the numeral 10 in FIG. 1. The knife has a lengthy metal blade 11, one end of which is enclosed by a handle 12, the remaining exposed portion being sharpened to a cutting edge 13 which terminates in a pointed extremity 14 to facilitate various kinds of thrusting and flesh penetrating movements. The handle 12 is preferably formed of rigid durable plastic material which is molded to the shank end of the blade and maintains cleanliness between blade and handle. The knife blade has a series of stepped serrations 15 formed closely adjacent the pointed end 14 which serrations are located on the non-cutting edge 16 of the blade. A plurality of serrations 15 of two or more having generally similar shapes is formed on the non-cutting edge 16 extending rearwardly toward the handle. It is preferred that the pointed upper extremities of the serrations point forwardly toward the knife point to increase their snagging ability on garment penetration. The serrations are relatively dull in comparison with the blade edge 13 and pointed end 14, the serrations being adapted to be snagged by the wearer of a protective garment and virtually all ordinary types of work clothing.

The number of serrations 15 range from about 3 to 7 in number having a height ranging from about 1 to 3 millimeters and a spacing of about 1½ to 6 millimeters. It is preferred that the serrations extend over a lineal dimension of about 30 millimeters from the pointed end of the blade to the last serration to allow for frequent sharpening of the blade cutting edge 13 over long-term use of the knife. In some cases the knife may be shortened by about 1½ to 1 inch at its pointed termination end following many sharpenings over the working life of a knife. Frequent sharpenings result in greater reduction in overall length of the knife blade. However, such sharpening does not result in the loss of all serrations which are capable of preventing protective garment penetration. The serrated point of the knife is snagged by the woven fabric of the protective garment to prevent deep penetration through the garment and into the body of the user. The serrations extend both upwardly and transversely of the longitudinal axis of the blade and may be directed forwardly or rearwardly depending upon desired end use.

Figure 2:
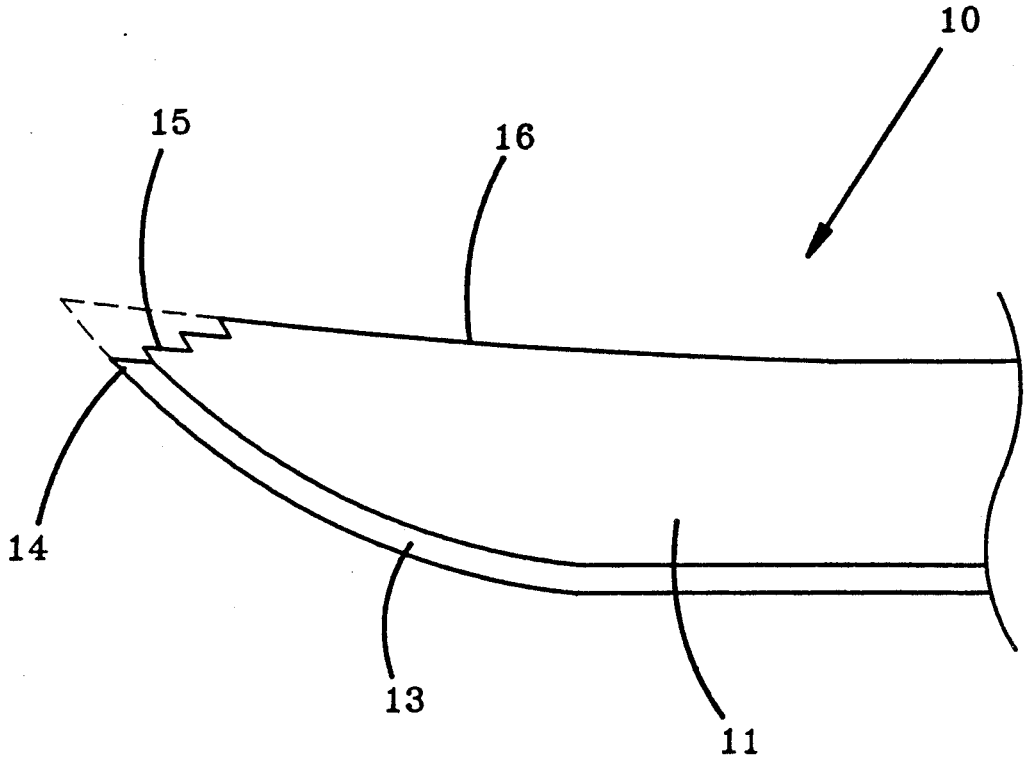
FIG. 2 is an enlarged side elevational view of the pointed end of the safety knife shown in FIG. 1.

FIG. 2 shows the serrations 15 formed adjacent the pointed end of a knife blade, the contour of a conventional knife end being shown in dotted outline. Thus, by grinding and/or cutting action the plurality of two or more serrations may be formed in stepped arrangement at the pointed end to provide the safety feature of the subject knife. The serrations are firmly engaged by the protective garment closely adjacent the sharpened point so that only limited restricted movement of the blade is permitted to occur upon thrusting or puncture-type movements of the knife into the garment.

Figure 3:
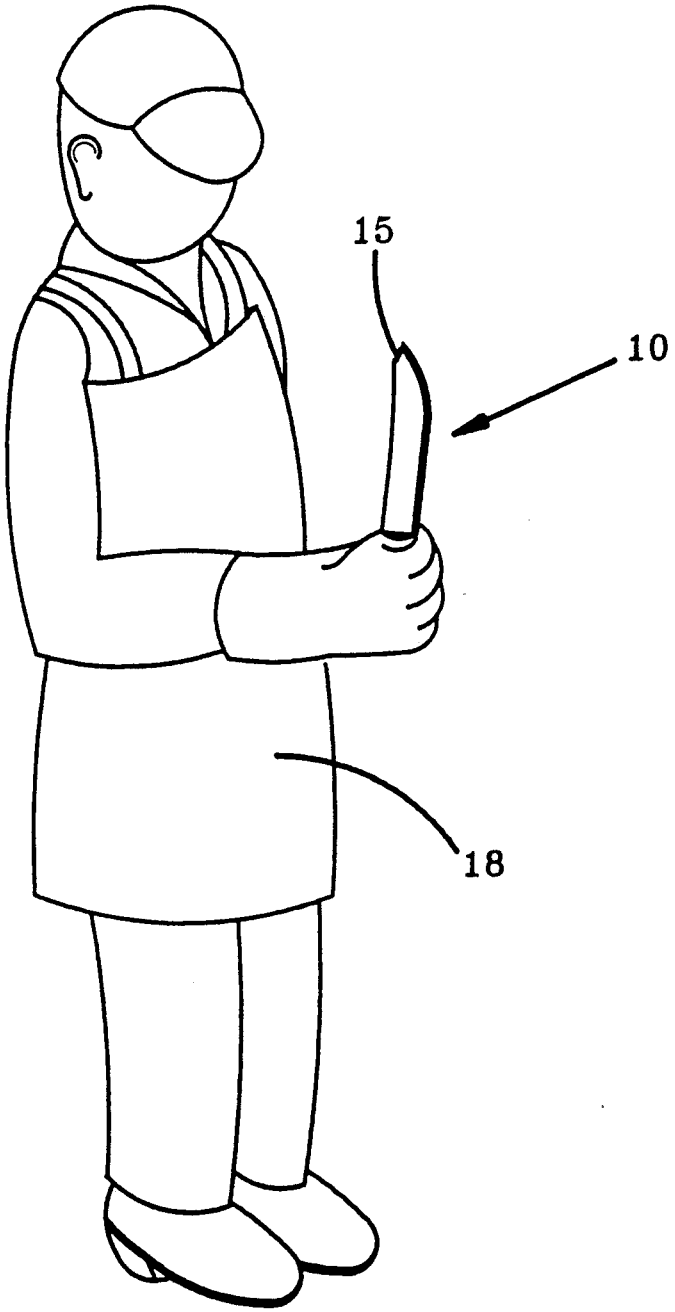
FIG. 3 is a perspective view of a commercial user of the subject knife.

FIG. 3 shows a commercial user of the safety knife 10 wearing a protective garment 18 such as that worn by professional meat-cutters during processing operations. The protective garment may be one formed in accordance with the referenced patents enumerated above or may be formed from a newly-developed multi-layered fabric as described hereinafter.

Figure 4:
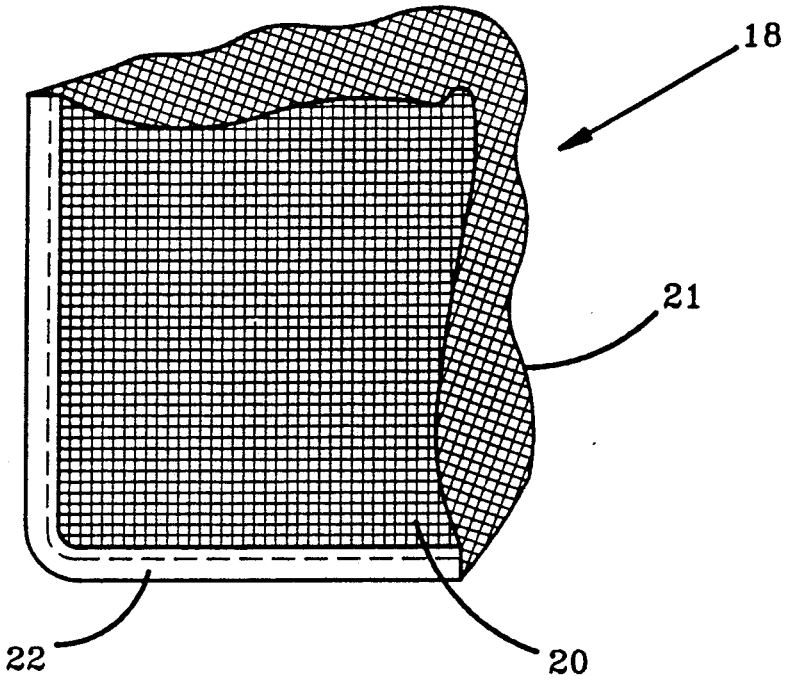
FIG. 4 is a fragmentary plan view of a multi-layered composite fabric of a protective garment.

One type of protective garment 18 is shown in FIG. 4 which is comprised of a multi-layered bias-structured garment including several fabric layers which may be adhered to one another and hemmed at their edges by a tightly sewn binding. The several layers are designated by the numerals 20 and 21 and the binding by the numeral 22.

The protective garment is preferably made from bias composite construction of woven and/or knitted hybrid covered yarn(s) and relatively low-velocity anti-ballistic material. The yarn is of the type which is cut-resistant hybrid yarn which is used in woven or knitted form as a stratum in composite multi-layered material providing cut/slash resistance and low-velocity anti-ballistic capacity. Such yarn is comprised of synthetic core elements including stainless steel filaments, polyester, nylon, fiberglass, Kevlar aramid fibers, Spectra fibers and the like. Core yarn is combined and wrapped with an outer cover or covers of any combination of core elements. Total yarn size is about 1700 to 2400 denier depending upon desired end use. For most severe usage additional stratum made from material demonstrating low-velocity anti-ballistic capacity from yarn in the 200 to 1500 denier range may be used which is combined in plain weave, basket weave or like constructions. Such composite fabrics may be combined in a wide variety of composite structures having two, three or more layers depending upon the various end applications of protective apparel.

Figure 5:
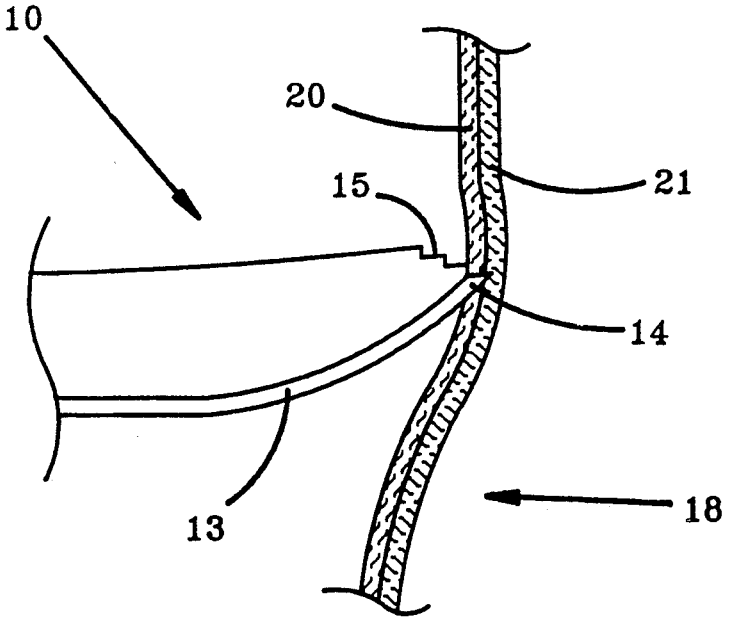
FIG. 5 is a fragmentary vertical sectional view of the garment and pointed end of the safety knife of the present invention.

As shown in FIG. 5, when the knife is subjected to thrusting or high-angular movement into or against the protective garment 18, the serrated end of the knife blade engages the garment and allows only limited penetration of the serrations 15 into the fabric where they are normally snagged by one or more of the serrations to limit or restrict deep penetration through the garment. While the cutting edge of the point may be extremely sharp, the relatively dull transversely extending serrations are seized by one or more layers of the garment to retard, and ultimately stop, the garment penetration from occurring. In extreme cases where the garment may be penetrated by the knife point, the more remotely located serrations in combination with the increasingly greater width of the knife blade prevent deep penetration of the garment and direct contact with the body of the garment wearer.

Garment 18 is preferably fabricated from two or more specifically designed fabric layers, at least one of the layers having properties of cut and slash resistance wherein the individual synthetic fibers of the layer possess significant strength against transverse cutting or severance by a knife blade or other sharp object. A second layer of the garment is one having anti-ballistic properties which are intended to retard penetration of low-velocity projectiles which may be forcefully thrust at the fabric from high-angular directions. This layer may be called ballistic resistant to stop thrusting or penetrating type movements of the knife blade into the fabric. The several layers may be adhesively joined, such as by a layer of rubber cement, so that the garment possesses moisture and water resistance, the cement or adhesive joining the several layers in tightly adhered relation. The several layers of the garment are normally laid at angles to each other to provide a bias structure possessing great strength against both cutting and thrusting actions of a knife blade.

The ballistic resistance of at least one of the fabrics is a designation which is employed to cover a wide range of denier types of filaments of various weave types to prevent penetration of the fabric such as used in metal grinding operations wherein relatively high-velocity fragments of metal may be suddenly and forcefully thrust against the fabric. This may occur when a metal part is being ground on a grinding wheel and either the part or wheel may shatter sending high speed fragments as projectiles against the garment comprised of such fabric. The protective garment may also be comprised of moisture resistant layers to provide easy cleaning and to keep the wearer dry. Where an outer plastic surface is provided, such surface also provides some protection against cutting and/or slashing movement of the knife blade by its relatively slippery surface especially when wet by processing water.

Figure 6:
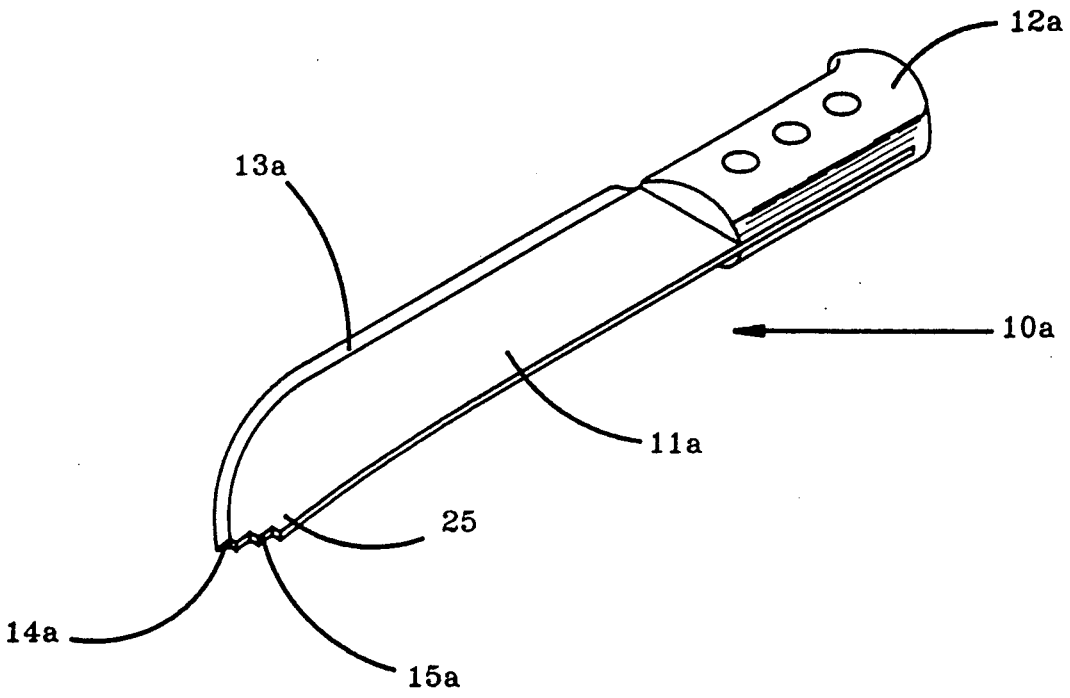
FIG. 6 is a perspective view of another embodiment of the safety knife.

FIG. 6 illustrates another embodiment of the safety knife **10*a* wherein the blade 11*a* has a raised portion 25 adjacent its terminating end. Such raised portion is utilized to form the plurality of serrations 15*a* closely adjacent the pointed end 14*a* of the knife blade. The normal straight sided or gently curving non-cutting edge of the blade is built up adjacent the point to provide a slightly enlarged area from which the serrations 15*a* may be formed. Only 3 serrations are shown in FIG. 6, however, it is preferred that 3 to 7 serrations are formed thereat having a height ranging from 1 to 3 millimeters with a spacing from about 3 to 6 millimeters, the serrations extending over about 30 millimeters of the pointed end. With such construction the cutting edge 14*a* and pointed end 14*a*** may be repeatedly sharpened over the working life of the knife without serious loss of the serrations although the blade may be shortened as the result of such sharpenings.

Figure 7:
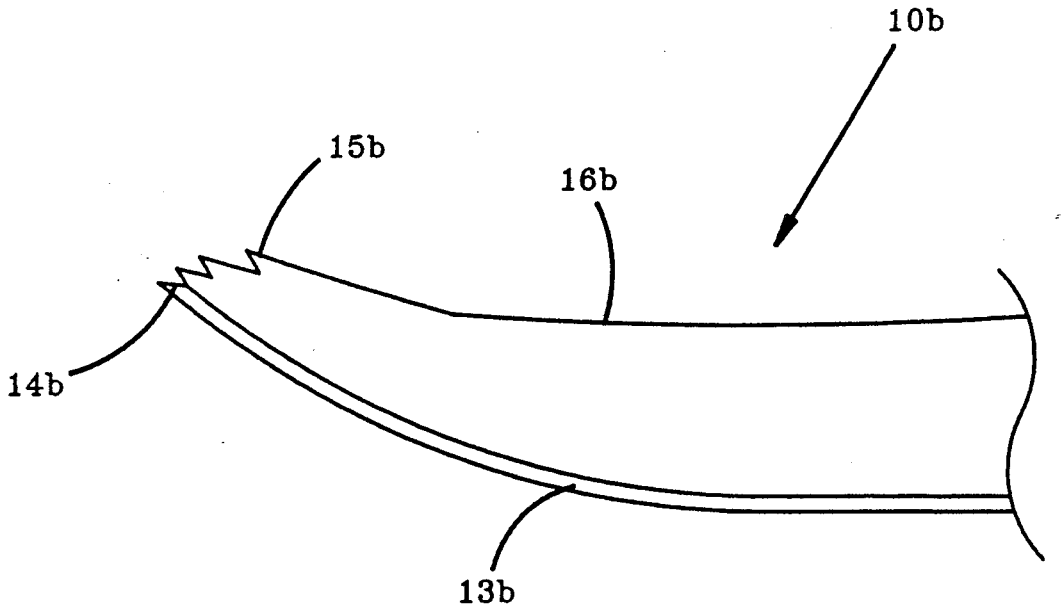
FIG. 7 is an enlarged side elevational view of the pointed blade end of a further embodiment of the safety knife.
Figure 8:
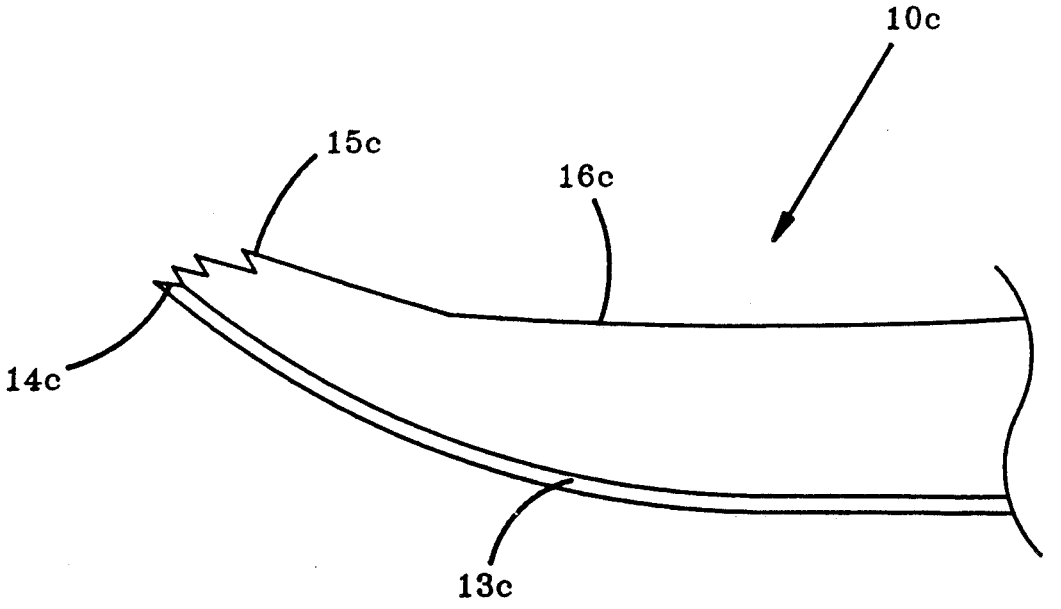
FIG. 8 is a view similar to FIG. 7 of still another embodiment of the safety knife.

FIGS. 7 and 8 show several other embodiments of the invention wherein the serrations 15*b* and 15*a* respectively may be formed in a built-up fashion closely adjacent the pointed end of the knife blade. As shown in FIG. 7 the serrations 15*b* are built up from the normal line of curvature of the non-cutting edge 16*b* of the blade as shown by dotted outline as shown in FIG. 8. The serrations 15*b* may be built up adjacent the pointed end such as by welding a separate serrated section thereto. Both of the illustrated types of plural serrations 15*b* and 15*c* show variations of the present invention which have special utility with some of the newly-developed protective garments which have significant resistance to thrusting or puncture-type blade movements. The sharpened pointed edges 14*b* and 14*c* generally lie on a plane or line of curvature slightly below the normal contour of the non-cutting edges 16*b* and 16*c*. The serrations are shaped to be highly valuable for snagging of a protective garment to prevent its penetration.

Accordingly, the improved safety knife and combination of safety knife and protective garment are simplified, provide an effective, safe, inexpensive, and efficient device and combination which achieves all the enumerated objectives, provide an elimination of difficulties encountered with prior devices, and solves problems and obtains new results in the art. Elimination of the use of heavy metal garments permits the use of much lighter weight protective apparel.

In the foregoing description, certain terms have been used for brevity, clearness and understanding; but no unnecessary limitations are to be implied therefrom beyond the requirement of the prior art, because such terms are used for descriptive purposes and are intended to be broadly construed.

More, the description and illustration of the invention is by way of example, and the scope of the invention is not limited to the exact details shown or described.

Having now described the features, discoveries and principles of the invention, the manner in which the improved safety knife and the combination of safety knife and protective garment are constructed and used, the characteristics of the construction, and the advantageous, new and useful results obtained; the new and useful structures, devices, elements, arrangements, parts and combinations, are set forth in the appended claims.

I claim:

1. A safety knife for cutting meat, fish and poultry including a handle and a blade, said blade having a non-cutting edge and a sharpened cutting edge terminating in a pointed end; a plurality of serrations formed on the non-cutting edge originating immediately adjacent the pointed end and extending in an upwardly stepped relationship from and above the pointed end toward the handle with said serrations being inclined toward the pointed end, to snag a protective garment worn by a user of the knife to prevent the pointed end from deep penetration through the garment and into the body of the user.

2. A safety knife in accordance with claim 1, wherein the said plurality of upwardly-projecting serrations range from 3 to 7 similarly-shaped serrations to permit sharpening the said cutting edge without loss of garment penetration protection provided by said serrations.

3. A safety knife in accordance with claim 1, wherein the said plurality of serrations are similarly-shaped and extend for a length of about 30 millimeters from the terminating pointed end, said serrations having a height ranging from about 1 to 3 millimeters and a spacing ranging from about 3 to 6 millimeters.

4. A safety knife in accordance with claim 1, wherein the said plurality of serrations range from about 3 to 7 in number and are staggered progressively rearwardly from the terminating pointed end of said blade.

5. The safety knife in accordance with claim 1, wherein the non-cutting edge has a smoothly-curved contour; and in which the said plurality of serrations project upwardly and forwardly from the smoothly-curved contour of the non-cutting edge of said blade.

6. In combination a knife and a protective garment for improved safety in the processing meat, fish and poultry including, said knife having a handle and a blade, said blade having a non-cutting edge and a sharpened cutting edge terminating in a pointed end; a plurality of serrations formed on the non-cutting edge originating immediately adjacent the pointed end and extending in an upwardly stepped relationship from and above the pointed end toward the handle, with said serrations being inclined toward the pointed end, to snag the protective garment worn by a user of the knife to prevent the pointed end from deep penetration through the garment and into the body of the user; and said protective garment adapted to be worn by the user of said safety knife being comprised of a multi-layered bias-structured composite fabric which is both cut/slash resistant and ballistic resistant to reduce knife point penetration of said garment and resultant injury to the user.

7. The combination in accordance with claim 6, wherein the said plurality of upwardly-projecting serrations are similarly-shaped and similarly-spaced to permit sharpening of said cutting edge without loss of garment penetration protection provided by said serrations.

8. The combination in accordance with claim 6, wherein the said plurality of serrations are similarly-shaped having a height ranging from abut 1 to 3 millimeters and a spacing ranging from about 3 to 6 millimeters.

9. The combination in accordance with claim 6, wherein the said plurality of serrations are similarly-shaped and extend over a dimension of about 30 millimeters from the pointed terminating end of said blade.

10. The combination in accordance with claim 6, wherein the said cut-resistant multi-layered composite fabric includes a metallic wire structure to prevent knife point penetration of said garment.

11. The combination in accordance with claim 6, wherein the said multi-layered bias-structured composite fabric provides both cut/slash resistance and low-velocity anti-ballistic resistance to prevent garment penetration by said knife point on thrusting movement of said knife with respect to said garment.

12. The combination in accordance with claim 6, wherein the said plurality of serrations extend upwardly from a lineal plane of the non-cutting edge of said blade.

13. The combination in accordance with claim 6, wherein the said cut-resistant multi-layered composite fabric comprises a first layer of cut/slash woven yarn, and a second layer of anti-ballistic woven material, both separately woven into an individual fabric integrally joined to form said protective garment.

14. The combination in accordance with claim 6, wherein the said cut-resistant multi-layered bias-structured composite fabric comprises at least one layer of cut/slash woven yarn containing a fine inter-woven metallic filament to prevent thrust-type penetration of said protective garment by the serrated point of said knife.

15. The combination in accordance with claim 6, wherein the said plurality of upwardly-projecting serrations are similarly-shaped and similarly-spaced located closely adjacent said terminating pointed end of said blade to prevent knife point penetration of said garment.

* * * * *